US008469427B1

(12) United States Patent
Mejia

(10) Patent No.: US 8,469,427 B1
(45) Date of Patent: Jun. 25, 2013

(54) DROP CEILING TITLE INSTALLATION TOOL

(76) Inventor: David Mejia, Miami, FL (US)

( * ) Notice: Subject to any disclaimer, the term of this patent is extended or adjusted under 35 U.S.C. 154(b) by 0 days.

(21) Appl. No.: 13/405,274

(22) Filed: Feb. 25, 2012

(51) Int. Cl.
*E04G 25/00* (2006.01)
*B66F 19/00* (2006.01)

(52) U.S. Cl.
USPC ..... 294/210; 294/209; 414/11

(58) Field of Classification Search
USPC ..... 294/209, 210, 211; 414/11; 254/354.1, 254/354.3, 354.5, 6 C, 133 R; 248/354.1, 248/354.3, 354.5; 52/127.1, 127.2, 749.1
See application file for complete search history.

(56) References Cited

U.S. PATENT DOCUMENTS

| | | | | | |
|---|---|---|---|---|---|
| 817,741 | A | | 4/1906 | Armstrong | |
| 2,939,590 | A | * | 6/1960 | Henry | 414/11 |
| 2,983,474 | A | * | 5/1961 | Hanna | 248/161 |
| 4,019,769 | A | * | 4/1977 | Filion | 294/86.4 |
| 4,027,802 | A | * | 6/1977 | Reynolds | 414/11 |
| 4,120,484 | A | * | 10/1978 | Zimmer | 254/6 C |
| 4,261,607 | A | | 4/1981 | Pilcher | |
| 4,300,751 | A | * | 11/1981 | Delaney | 414/11 |
| 4,335,913 | A | | 6/1982 | Lick | |
| 4,695,028 | A | * | 9/1987 | Hunter | 414/11 |
| 5,052,733 | A | | 10/1991 | Cheung et al. | |
| 5,129,774 | A | * | 7/1992 | Balseiro et al. | 414/11 |
| 5,322,403 | A | * | 6/1994 | Herde | 414/11 |
| 5,979,854 | A | * | 11/1999 | Lundgren et al. | 248/354.3 |
| 6,471,270 | B1 | | 10/2002 | Mituniewicz | |
| D561,543 | S | | 2/2008 | Callander | |
| D592,822 | S | * | 5/2009 | Boucher et al. | D34/31 |

* cited by examiner

*Primary Examiner* — Paul T Chin

(57) ABSTRACT

A drop ceiling tile installation tool is provided for facilitating installation of ceiling tiles into a drop ceiling. The tool includes a pole and a connector coupled to a first end of the pole. A plurality of support arms is coupled to and extends outwardly from the connector. The support arms include a pair of upper support arms and a pair of lower support arms. A pair of hooks is coupled to and extends from distal ends the lower support arms relative to the connector whereby the hooks are configured for receiving and supporting an edge of a ceiling tile. A pair of tile support panels is coupled to distal ends of the upper support arms relative to the connector whereby the tile support panels are configured for supporting a bottom surface of a ceiling tile when the edge of the ceiling tile is received by the pair of hooks.

10 Claims, 3 Drawing Sheets

DROP CEILING TITLE INSTALLATION TOOL

BACKGROUND OF THE DISCLOSURE

1. Field of the Disclosure

The disclosure relates to ceiling tile installation devices and more particularly pertains to a new ceiling tile installation device for facilitating installation of ceiling tiles into a drop ceiling without scaffolding or ladders.

2. Summary of the Disclosure

An embodiment of the disclosure meets the needs presented above by generally comprising a pole having a first end and a second end. A connector is coupled to the first end of the pole. A plurality of support arms is coupled to and extends outwardly from the connector. The support arms include a pair of upper support arms and a pair of lower support arms. A pair of hooks is coupled to and extends from distal ends the lower support arms relative to the connector whereby the hooks are configured for receiving and supporting an edge of a ceiling tile. A pair of tile support panels is coupled to distal ends of the upper support arms relative to the connector whereby the tile support panels are configured for supporting a bottom surface of a ceiling tile when the edge of the ceiling tile is received by the pair of hooks.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
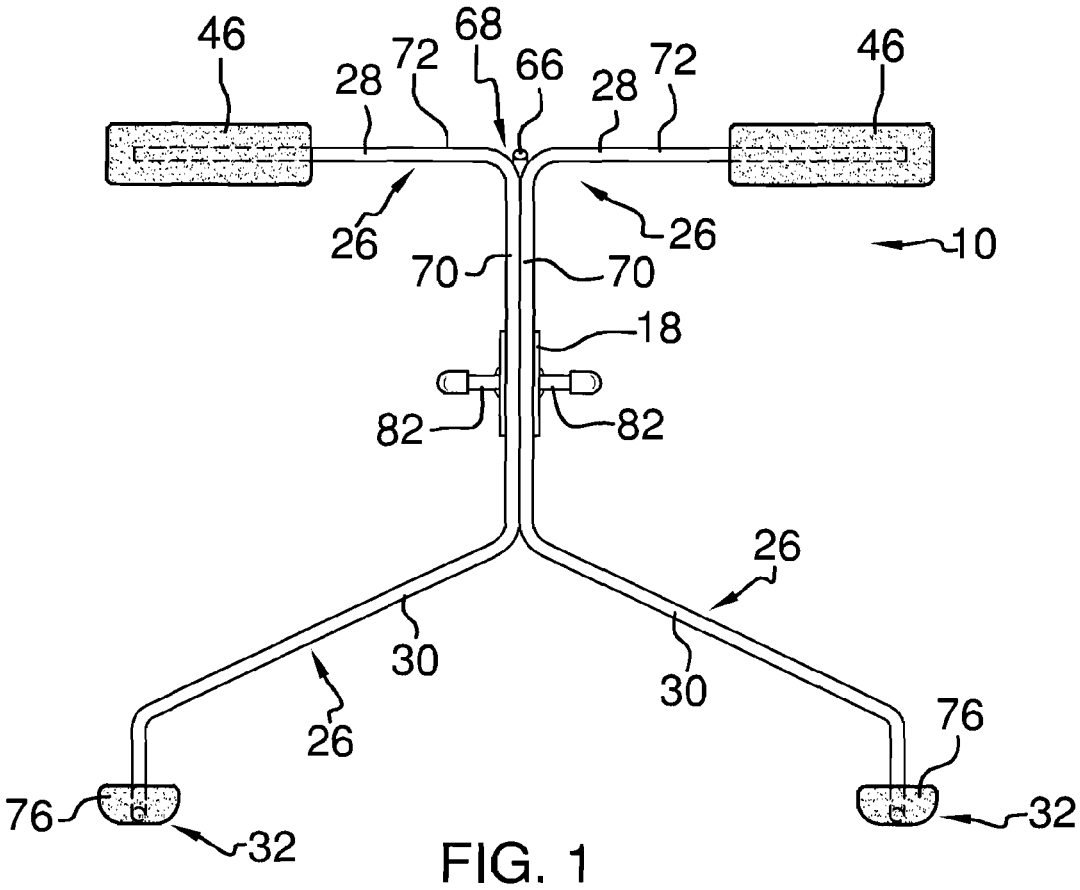
FIG. 1 is a top view of a drop ceiling tile installation tool according to an embodiment of the disclosure.
Figure 2:
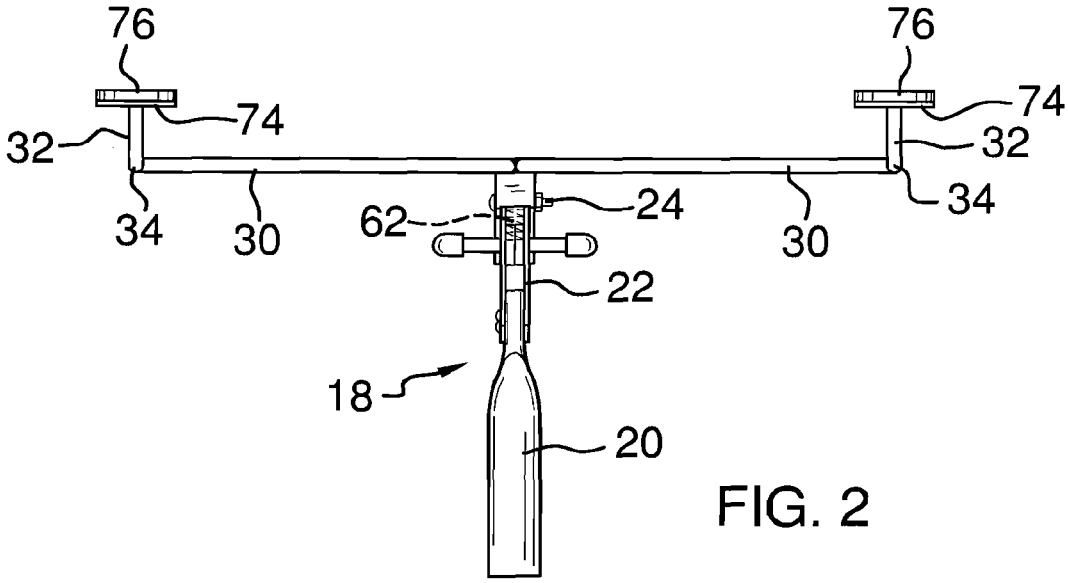
FIG. 2 is a front view of an embodiment of the disclosure.
Figure 3:
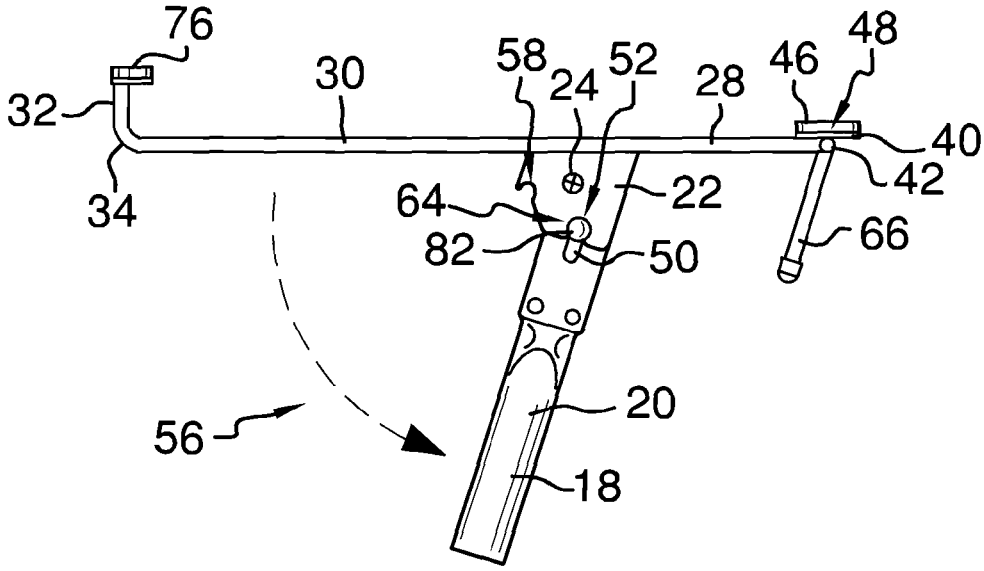
FIG. 3 is a side view of an embodiment of the disclosure.
Figure 4:
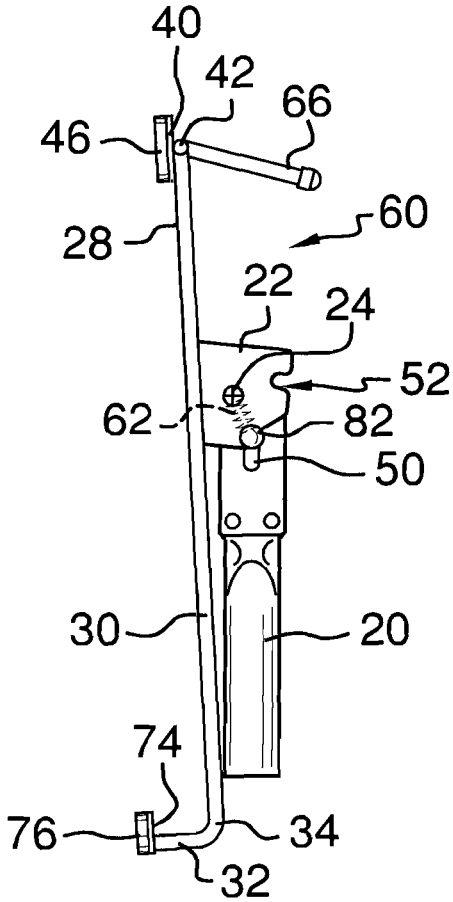
FIG. 4 is a side view of an embodiment of the disclosure.
Figure 5:
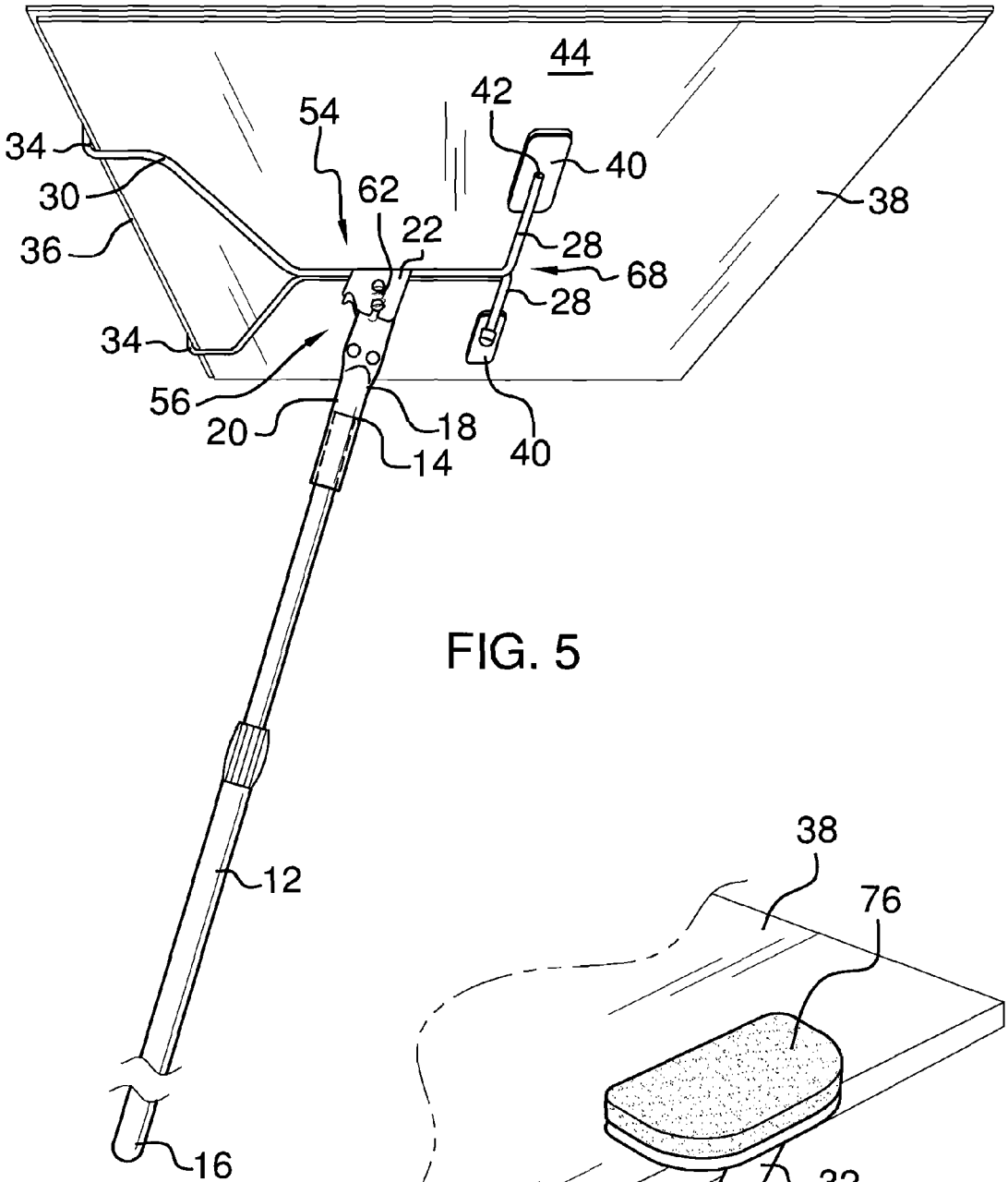
FIG. 5 is a bottom rear side perspective view of an embodiment of the disclosure in use.
Figure 6:
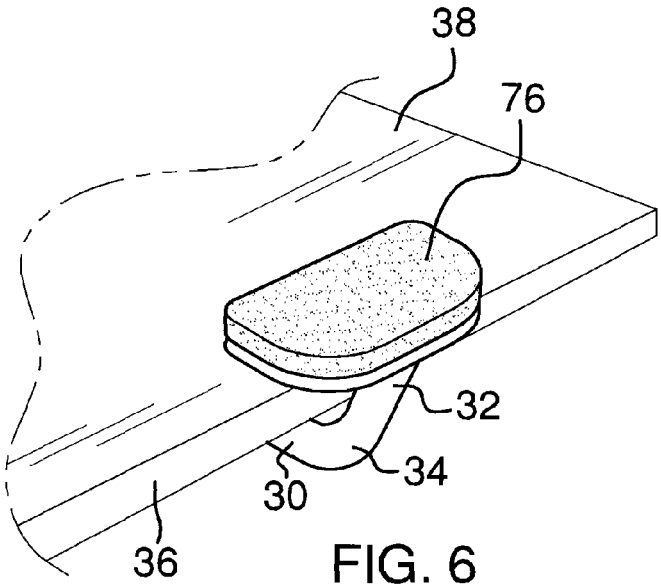
FIG. 6 is a close up top rear side perspective view of an embodiment of the disclosure in use.

With reference now to the drawings, and in particular to FIGS. 1 through 6 thereof, a new ceiling tile installation device embodying the principles and concepts of an embodiment of the disclosure and generally designated by the reference numeral 10 will be described.

As best illustrated in FIGS. 1 through 6, the drop ceiling tile installation tool 10 generally comprises a telescopic pole 12 having a first end 14 and a second end 16. A connector 18 is coupled to the first end 14 of the pole 12. The connector 18 has a lower section 20 pivotally coupled to an upper section 22 by a hinge pin 24. A plurality of support arms 26 is coupled to and extends outwardly from the connector 18. The support arms 26 include a pair of upper support arms 28 and a pair of lower support arms 30. A pair of hooks 32 is coupled to and extends from a distal end 34 of an associated one of the lower support arms 30 relative to the connector 18. Thus, the hooks 32 are configured for receiving and supporting an edge 36 of a ceiling tile 38. A pair of tile support panels 40 is also provided. Each tile support panel 40 is coupled to a distal end 42 of an associated one of the upper support arms 28 relative to the connector 18. Thus, the tile support panels 40 are configured for supporting a bottom surface 44 of the ceiling tile 38 when the edge 36 of the ceiling tile 38 is received by the pair of hooks 32. A pair of support pads 46 may be provided with each support pad 46 being coupled to an associated one of the support panels 40. Each support pad 46 may cover an entirety of an upper surface 48 of the associated one of the support panels 40.

A locking pin 82 may be coupled to the connector 18 to engage the lower section 20 and the upper section 22 whereby the upper section 22 is held in a static position relative to the lower section 20. A slot 50 is positioned in and extends through the lower section 20 of the connector 18. The locking pin 82 is positioned in and extends out of the slot 50. The locking pin 82 may extend out of one side or out of opposite sides of the lower section 20. A first notch 52 is positioned in the upper section 22 of the connector 18 offset from the hinge pin 24. The first notch 52 is positioned to be engaged by the locking pin 82 when the connector 18 is in a use position 54 whereby the pole 12 extends rearwardly and away from the upper support arms 28 such that the pole 12 forms an acute angle 56 with the lower support arms 30. A second notch 58 is provided in the upper section 22 of the connector 18. The second notch 58 is positioned to be engaged by the locking pin 82 when the connector 18 is in a storage position 60 such that the support arms 26 are positioned parallel to the pole 12. A biasing member 62 is coupled between the locking pin 82 and the connector 18. The biasing member 62 urges the locking pin 82 towards the upper section 22 of the connector 18 into an engagement position 64 with the upper section 22 of the connector 18.

A handle 66 may be coupled to and extend from a junction 68 between the upper support arms 28. The upper support arms 28 may be generally L-shaped having first portions 70 extending from the connector 18 to the junction 68 and second portions 72 extending away from each other.

A distal portion 74 of each hook 32 relative to the lower support arms 30 is planar. A pair of cushions 76 may each be coupled to an upper surface 78 of an associated one of the distal portions 74 of the hooks 32. The cushion 76 may cover an entirety of the upper surface 78 of the distal portion 74 of the hook 32 relative to the lower support arms 30.

In use, the ceiling tile 38 is positioned in the support arms 26 with weight distributed so that the tile 38 is supported. The pole 12 is adjusted to a desired length to allow manipulation of the pole 12 to place the ceiling tile 38 in a desired position. The pole 12 may be manipulated to position the tile 38. When the tile 38 is in the desired position the pole 12 is manipulated to slide the support arms 26 off of the tile 38. The locking pin 82 may be manipulated to permit pivoting of the upper section 22 relative to the lower section 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A drop ceiling tile installation tool comprising:

a pole having a first end and a second end;

a connector coupled to said first end of said pole, said connector having a lower section pivotally coupled to an upper section;

a plurality of support arms coupled to and extending outwardly from said connector, said support arms including a pair of upper support arms and a pair of lower support arms;

a pair of hooks, each hook being coupled to and extending from a distal end of an associated one of said lower support arms relative to said connector whereby said hooks are configured for receiving and supporting an edge of a ceiling tile; and a pair of tile support panels, each said tile support panel being coupled to a distal end of an associated one of said upper support arms relative to said connector whereby said tile support panels are configured for supporting a bottom surface of a ceiling tile when the edge of the ceiling tile is received by said pair of hooks;

a locking pin coupled to said connector, said connector engaging said lower section and said upper section whereby said upper section is held in a static position relative to said lower section;

a slot positioned in and extending through said lower section of said connector;

said locking pin being positioned in and extending out of said slot; and a first notch in said upper section of said connector, said first notch being positioned to be engaged by said locking pin when said connector is in a use position whereby said pole extends rearwardly and away from said upper support arms such that said pole forms an acute angle with said lower support arms.

2. The tool of claim 1, further including a pair of support pads, each support pad being coupled to an associated one of said support panels.

3. The tool of claim 2, further including each said support panel covering an entirety of an upper surface of said associated one of said support panels.

4. The tool of claim 1, further including said pole being telescopic.

5. The tool of claim 1, further including a second notch in said upper section of said connector, said second notch being positioned to be engaged by said locking pin when said connector is in a storage position such that said support arms are positioned parallel to said pole.

6. The tool of claim 1, further including a biasing member coupled between said locking pin and said connector, said biasing member urging said locking pin towards said upper section of said connector into an engagement position with said upper section of said connector.

7. The tool of claim 1, further including a handle coupled to and extending from a junction between said upper support arms.

8. The tool of claim 1, further comprising:

a distal portion of each said hook relative to said lower support arms being planar; and a pair of cushions, each said cushion being coupled to an upper surface of an associated one of said distal portions of said hooks.

9. The tool of claim 8, further including each said cushion covering an entirety of said upper surface of said distal portion of said hook relative to said lower support arms.

10. A drop ceiling tile installation tool comprising:

a telescopic pole having a first end and a second end;

a connector coupled to said first end of said pole, said connector having a lower section pivotally coupled to an upper section by a hinge pin;

a plurality of support arms coupled to and extending outwardly from said connector, said support arms including a pair of upper support arms and a pair of lower support arms;

a pair of hooks, each hook being coupled to and extending from a distal end of an associated one of said lower support arms relative to said connector whereby said hooks are configured for receiving and supporting an edge of a ceiling tile;

a pair of tile support panels, each said tile support panel being coupled to a distal end of an associated one of said upper support arms relative to said connector whereby said tile support panels are configured for supporting a bottom surface of a ceiling tile when the edge of the ceiling tile is received by said pair of hooks;

a pair of support pads, each support pad being coupled to an associated one of said support panels, each said support pad covering an entirety of an upper surface of said associated one of said support panels;

a locking pin coupled to said connector, said connector engaging said lower section and said upper section whereby said upper section is held in a static position relative to said lower section;

a slot positioned in and extending through said lower section of said connector, said locking pin being positioned in and extending out of said slot;

a first notch in said upper section of said connector, said first notch being positioned to be engaged by said locking pin when said connector is in a use position whereby said pole extends rearwardly and away from said upper support arms such that said pole forms an acute angle with said lower support arms;

a second notch in said upper section of said connector, said second notch being positioned to be engaged by said locking pin when said connector is in a storage position such that said support arms are positioned parallel to said pole;

a biasing member coupled between said locking pin and said connector, said biasing member urging said locking pin towards said upper section of said connector into an engagement position with said upper section of said connector;

a handle coupled to and extending from a junction between said upper support arms;

a distal portion of each said hook relative to said lower support arms being planar; and a pair of cushions, each said cushion being coupled to an upper surface of an associated one of said distal portions of said hooks, each said cushion covering an entirety of said upper surface of said distal portion of said hook relative to said lower support arms.

* * * * *